US006629434B2

(12) United States Patent
Chia et al.

(10) Patent No.: US 6,629,434 B2
(45) **Date of Patent: *Oct. 7, 2003**

(54) DECORATIVE JEWELRY ARTICLE

(76) Inventors: Meang K. Chia, 412 W. 6th St., Suite 1104, Los Angeles, CA (US) 90014; Cheo K. Chia, 412 W. 6th St., Suite 1104, Los Angeles, CA (US) 90014; Huy K. Chia, 412 W. 6th St., Suite 1104, Los Angeles, CA (US) 90014

( * ) Notice: Subject to any disclaimer, the term of this patent is extended or adjusted under 35 U.S.C. 154(b) by 0 days.

This patent is subject to a terminal disclaimer.

(21) Appl. No.: 09/953,626

(22) Filed: Sep. 14, 2001

(65) Prior Publication Data

US 2002/0026808 A1 Mar. 7, 2002

Related U.S. Application Data

(63) Continuation of application No. 09/224,936, filed on Dec. 31, 1998, now abandoned.

(51) Int. Cl.[7] ..... A44C 17/02
(52) U.S. Cl. ..... 63/26; 63/3; 63/28; 63/29.1
(58) Field of Search ..... 63/3, 3.1, 4, 23, 63/26, 28, 29.1, 37, 1.11, 1.12, 1.14, 1.16; D11/3, 6, 79, 91; 29/10; 206/8, 82; 40/1.5, 1.6

(56) References Cited

U.S. PATENT DOCUMENTS

| | | | |
|---|---|---|---|
| D12,579 | S | 11/1881 | Reynolds |
| D14,818 | S | 2/1884 | Merril |
| 439,139 | A | 10/1890 | Gaynor |
| 569,495 | A | 10/1896 | Gunther |
| 572,237 | A | 12/1896 | Adams |
| D32,439 | S | 4/1900 | Gay |

(List continued on next page.)

FOREIGN PATENT DOCUMENTS

| | | | |
|---|---|---|---|
| CH | 238894 | | 8/1945 |
| EP | 0 063 751 | A1 | 11/1982 |
| FR | 608150 | | 7/1926 |
| FR | 709603 | | 8/1931 |
| FR | 1 319 354 | A | 5/1963 |
| GB | 1 077 460 | | 7/1967 |
| GB | 1 200 257 | | 7/1970 |
| GB | 2 070 344 | A | 9/1981 |
| GB | 2 077 441 | A | 12/1981 |
| WO | 00/38551 | A1 | 7/2000 |

OTHER PUBLICATIONS

*A&A Jewerly Tools & Findings;* Smooth edge coin, w/4 prong w/bail; 7 pages including G92.

*All Karats International;* Edizioni, Primavera–Estate/Spring–Summer, Sixth Edition; "Diamond Necklace"; 2 pages including cover (1998).

(List continued on next page.)

*Primary Examiner*—Andrea Chop
(74) *Attorney, Agent, or Firm*—Ladas & Parry

(57) ABSTRACT

A decorative jewelry module comprises a base member with a hollow interior, a decorative insert, and a fastener arrangement. The hollow base member has a top with an opening therein, a bottom, and an interior. The decorative insert is sized in relation to the interior of the base member so as to be placed within the hollow base member and viewed through the top opening. The fastener arrangement fixes the decorative insert within the hollow base member below the base member top. The decorative jewelry article may be manufactured as a multi-part base and decorative insert combination, or as a monolithic jewel article having a base portion and a decorative element portion. The jewelry article may be designed to have the appearance of a single decorative unit, or to have the appearance of a double (or greater) decorative unit. Such units have application in many jewelry items. A number of such units may be connected in series to form a tennis bracelet.

24 Claims, 8 Drawing Sheets

U.S. PATENT DOCUMENTS

| | | | |
|---|---|---|---|
| D32,649 | S | 5/1900 | McCutchen et al. |
| 795,109 | A | 7/1905 | Dover |
| 813,084 | A | 2/1906 | Dover |
| 851,078 | A | 4/1907 | Dunn |
| 1,001,583 | A | 8/1911 | Fairbrother |
| 1,024,048 | A | 4/1912 | Abel |
| D42,514 | S | 5/1912 | Meyers |
| D42,643 | S | 6/1912 | Meyers |
| 1,153,362 | A | 9/1915 | Wacha |
| D48,950 | S | 4/1916 | Rosenberger |
| 1,189,497 | A | 7/1916 | Schwartzman |
| 1,344,365 | A | 6/1920 | Wachenheimer |
| D55,597 | S | 7/1920 | Felger |
| D56,605 | S | 11/1920 | Grasmuk |
| D56,607 | S | 11/1920 | Grasmuk |
| 1,410,366 | A | 3/1922 | Buchman |
| 1,433,521 | A | 10/1922 | Albanese |
| 1,443,654 | A | 1/1923 | Schmidt |
| 1,467,468 | A | 9/1923 | Blanchard |
| 1,556,465 | A | 10/1925 | Wendel |
| 1,570,776 | A | 1/1926 | Peters |
| 1,570,932 | A | 1/1926 | Anderson et al. |
| 1,589,423 | A | 6/1926 | Payton |
| D76,664 | S | 10/1928 | Chase |
| D77,434 | S | 1/1929 | Rice |
| 1,701,610 | A | 2/1929 | Forstner |
| 1,710,660 | A | 4/1929 | Guyot |
| D84,213 | S | 5/1931 | Speidel |
| 1,842,427 | A | 1/1932 | Sammartino |
| 1,854,958 | A | 4/1932 | Santosuosso |
| 1,892,738 | A | 1/1933 | Schnarr |
| 1,981,696 | A | 11/1934 | Harper |
| D110,568 | S | 7/1938 | Garfinkel |
| D117,577 | S | 11/1939 | Sand |
| D119,286 | S | 3/1940 | Somers |
| 2,273,227 | A | 2/1942 | Simmons |
| D131,750 | S | 3/1942 | Hobe |
| D131,847 | S | 3/1942 | Hobe |
| D143,583 | S | 1/1946 | Feingold |
| D143,588 | S | 1/1946 | Grun |
| D143,750 | S | 2/1946 | Philippe |
| D144,901 | S | 6/1946 | Braunstein |
| D145,426 | S | 8/1946 | Braunstein |
| D146,779 | S | 5/1947 | Slater |
| D151,904 | S | 11/1948 | Katz |
| D155,873 | S | 11/1949 | Chernow |
| D156,650 | S | 12/1949 | Peagle et al. |
| D156,744 | S | 1/1950 | Kent |
| D159,528 | S | 8/1950 | Philippe |
| D159,582 | S | 8/1950 | Boucher |
| D160,241 | S | 9/1950 | Bardach |
| 2,526,134 | A | 10/1950 | Henry |
| 2,538,090 | A | 1/1951 | Ferragamo |
| D165,468 | S | 12/1951 | Katz |
| 2,584,207 | A | 2/1952 | Holl |
| 2,634,593 | A | 4/1953 | Moretti |
| D176,664 | S | 1/1956 | Katz |
| 2,852,923 | A | 9/1958 | Gamelsky |
| D184,930 | S | 4/1959 | Gonicberg |
| D186,903 | S | 12/1959 | Hess |
| 3,025,820 | A | 3/1962 | Rosenthal |
| D202,723 | S | 11/1965 | Gaston |
| 3,483,716 | A | 12/1969 | Stenzler |
| 3,670,524 | A | 6/1972 | Korwin |
| 4,154,282 | A | 5/1979 | Kull |
| 4,165,574 | A | 8/1979 | Sciotti |
| D257,017 | S | 9/1980 | Barr |
| D265,639 | S | 8/1982 | Barr |
| D266,954 | S | 11/1982 | Gordan |
| 4,399,910 | A | 8/1983 | Gutentag |
| 4,488,415 | A | 12/1984 | Jenkins |
| D277,466 | S | 2/1985 | Chien |
| 4,551,993 | A | 11/1985 | Nagahori |
| 4,566,294 | A | 1/1986 | Brzozowski |
| 4,763,489 | A | 8/1988 | Strong |
| 4,781,038 | A | 11/1988 | Branca et al. |
| D314,528 | S | 2/1991 | Chia et al. |
| D314,730 | S | 2/1991 | Chia et al. |
| D314,929 | S | 2/1991 | Chia et al. |
| D317,139 | S | 5/1991 | Chia et al. |
| D317,423 | S | 6/1991 | Chia et al. |
| D319,033 | S | 8/1991 | Chia et al. |
| 5,056,337 | A | 10/1991 | Nhaissi |
| D322,043 | S | 12/1991 | Chia et al. |
| D325,180 | S | 4/1992 | Chia et al. |
| D325,709 | S | 4/1992 | Chia et al. |
| D325,710 | S | 4/1992 | Chia et al. |
| D325,711 | S | 4/1992 | Chia et al. |
| D325,886 | S | 5/1992 | Chia et al. |
| D329,026 | S | 9/1992 | Chia et al. |
| D329,206 | S | 9/1992 | Chia et al. |
| D329,401 | S | 9/1992 | Chia et al. |
| D331,726 | S | 12/1992 | Chia et al. |
| D335,639 | S | 5/1993 | Chia et al. |
| D336,057 | S | 6/1993 | Chia et al. |
| D336,059 | S | 6/1993 | Chia et al. |
| D336,060 | S | 6/1993 | Chia et al. |
| D337,069 | S | 7/1993 | Chia et al. |
| D337,070 | S | 7/1993 | Chia et al. |
| D337,283 | S | 7/1993 | Keshishian |
| D337,546 | S | 7/1993 | Keshishian |
| D337,547 | S | 7/1993 | Keshishian |
| D338,852 | S | 8/1993 | Keshishian |
| 5,355,698 | A | 10/1994 | Edmark |
| 5,365,754 | A | 11/1994 | Nalbandian |
| D379,074 | S | 5/1997 | Udko |
| D388,016 | S | 12/1997 | Kejejian |
| 5,694,791 | A | 12/1997 | Esposito |
| 5,806,345 | A | 9/1998 | Bonchek |
| D406,247 | S | 3/1999 | Chia et al. |
| 5,992,177 | A | 11/1999 | Beard |
| D418,445 | S | 1/2000 | Chia et al. |
| D418,446 | S | 1/2000 | Chia et al. |
| D423,981 | S | 5/2000 | Chia et al. |
| 6,116,054 | A | 9/2000 | Czupor |

OTHER PUBLICATIONS

California Gold Center; Bezel–set jewerly; 1 page.

Caroline Ballou Collection; 18K Tribal Interpretations; and Barnett Robinson, Inc.; 18k yellow gold and platinum rings (1 page).

"Charms" catalog by Americas Gold; Item #136–20; p. 136.

Corona; Corona's Lasting Treasures Collection; Item SS 424 of.

Crafford Precision Products Co.; "Laser Spot–Welding Systems"; (1997).

*Fancy Catalog,* Item Nos. 1111, 11112, 11114, p. 111 (total 14 pages).

Gervais, J.; "A Little Light Welding", *AJM,* 4 pages (May 1998).

Hans D. Krieger; "JCK Show" catalog insert.

Hans D. Krieger; "Platinum Classic"; A Promotional Supplement to *Jewelers' Circular Keystone,* p. 178 (May 1997).

Jaha Jewelry Inc.; 6 pages total including J6, J10, J13.

Janet Aliz necklace, *Jewelers' Circular Keystone*p. 132 (May 1997).

"Liberty Collections" by Liberty I. Exchange; pp. 4 and 21 (Item 6ML–588 6.1gr).
"Love Tears Collection" by Studs, Inc., *Jewelers' Circular Keystone;* diamond solitaire necklaces in 18K gold; (Dec. 1997).
Maty, Collection Automne—Hiver 97–98, Valeur 30F, No. 76; 1 page.
Mervyn's California catalog flyer; #14; Cache fashion watch; p. 11 (1998).
*National Jeweler;* Items #P10529, #84622, (May 16, 1997).
P.Q.C. Jewelry; *National Jeweler;* Item N362, p. 142 (Jun. 1, 1998).
"Rio Grande: Gems & Findings"; Gold earrings, 14K yellow back–set French wire earrings Die Struck, Item "M", cover page and p. 90.
*Robinson's May,* Earring, Item No. 290131409, Purchased Apr. 18, 1999, 3 pages.
S&R Designs, Inc.; 18k Diamond Flower necklace, earrings, and bar bracelet; Style Europa, 18k 2–one gold ring, bracelet, necklace with diamonds; 1 page.
Superior Diamond Cutters Inc.; *Jewelers' Circular Keystone;* Platinum and 18k gold slide pendant with diamonds; p. 108 (Dec. 1997).
*The Gold Book,* Oro America, Items HE.142(A) 2.37gr. (89), HE.141 (A) 2.37gr. (89), HE.143 (A) 2.89gr. (108), p. 18 (1996).
*The Multi–Color Gold Jewelry Book,* Oro America, Earring Items: ETR.014.95(39); ETR.022 1.0(42); ETLB.0011.7(71); p. 1.
The Vatican Library Collection, *Jewelers' Circumlar Keystone;* Skalet gold; Item 4D and 4I, 1 page.
Uni–Creation Inc., Emby International Inc. Collection.; 1 page.
Variety Gem Co., Inc.; *JCK Catalog* 05–97; Items N5526, N5520A, N5520B; one page (May 1997).
Wards, Gold Hoop (Earring) with Diamond Cut Ovals, Item #459312000; 4 pages.

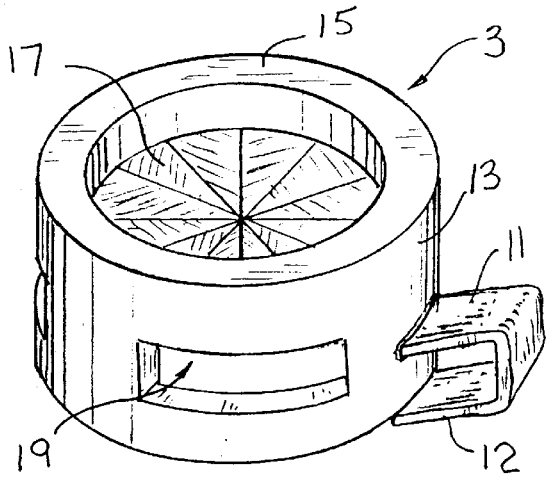
Fig. 5
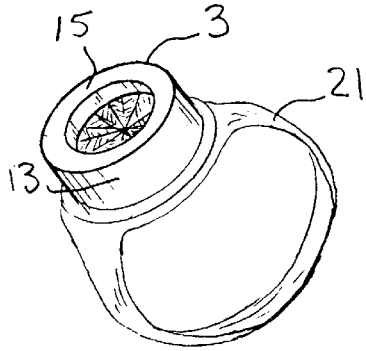
Fig. 6
Fig. 7
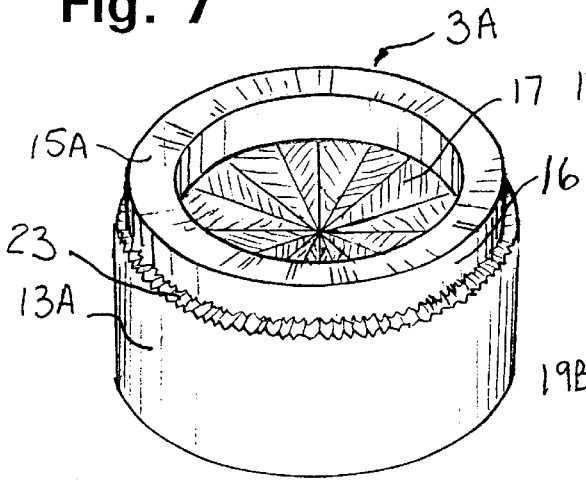
Fig. 8
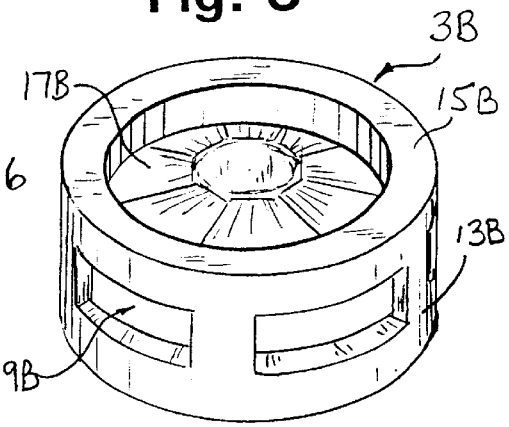
Fig. 11
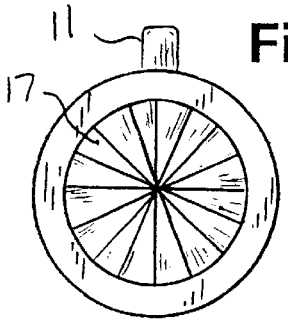
Fig. 9
Fig. 10
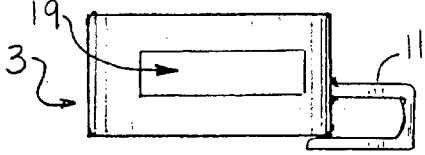
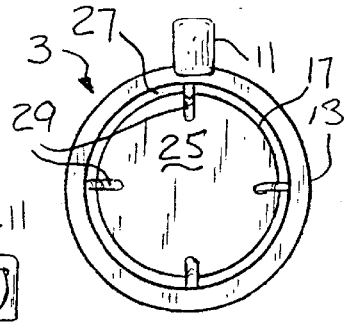

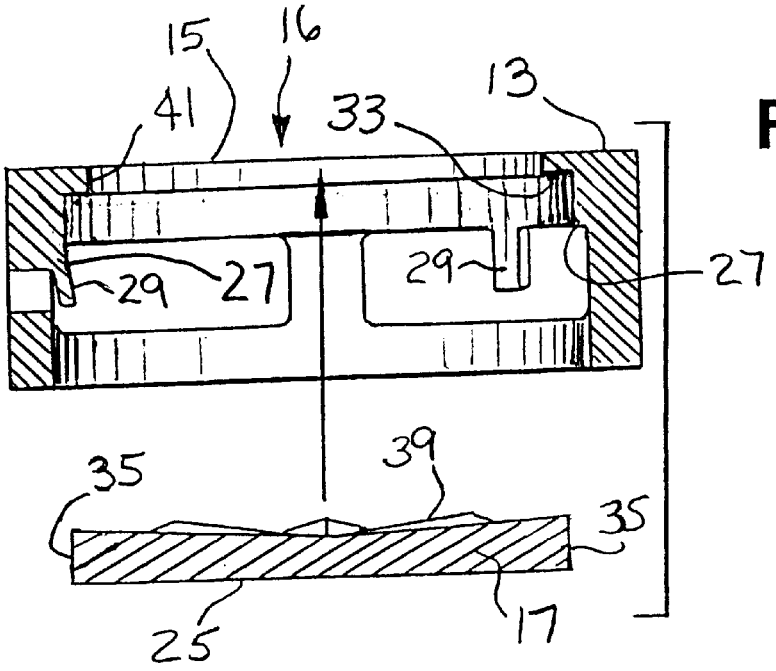
Fig. 12
Fig. 13
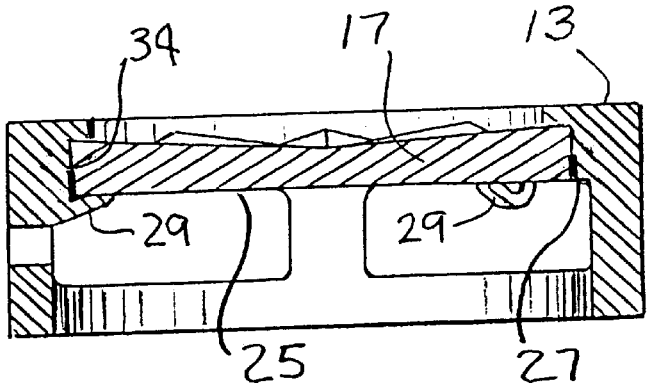
Fig. 14
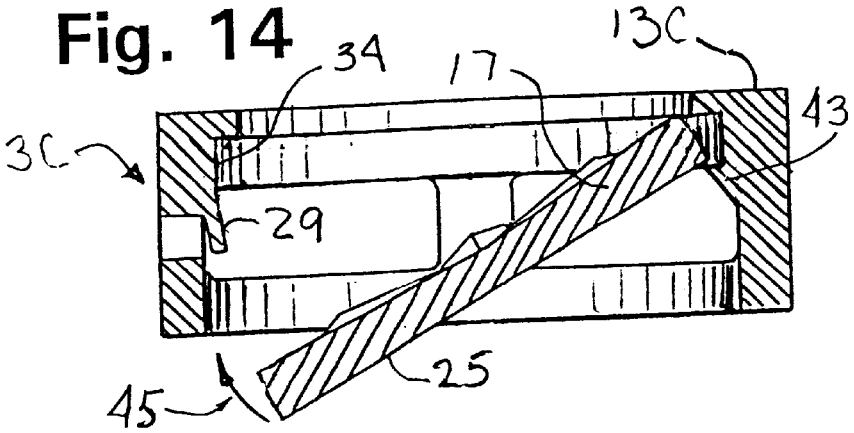

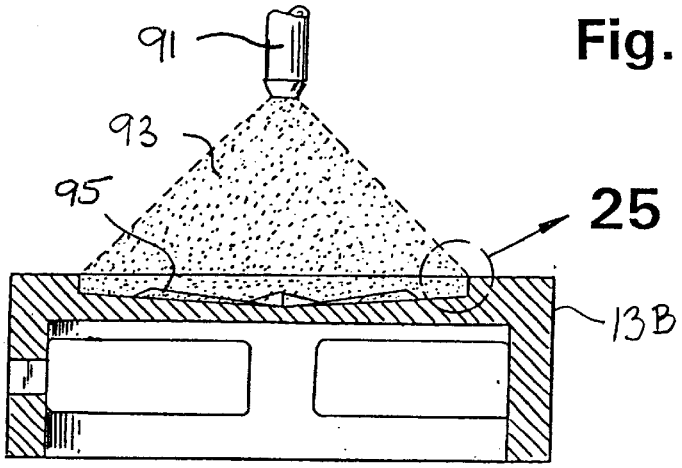
Fig. 24
Fig. 25
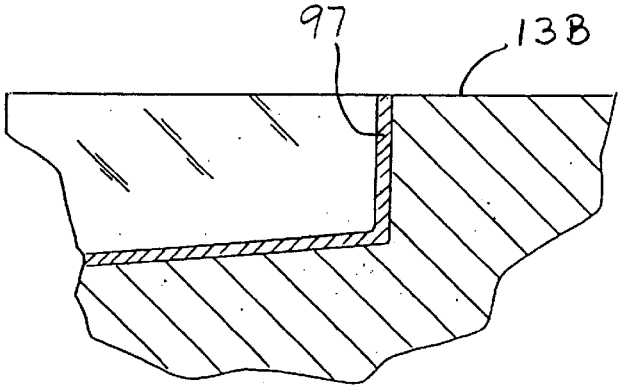
Fig. 26
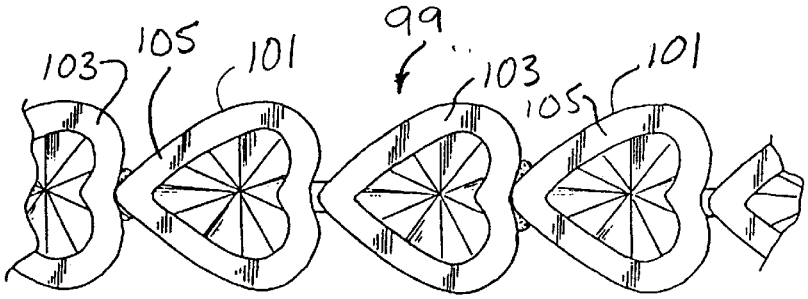
Fig. 27
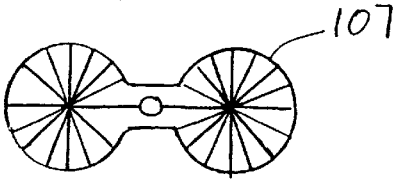
Fig. 28
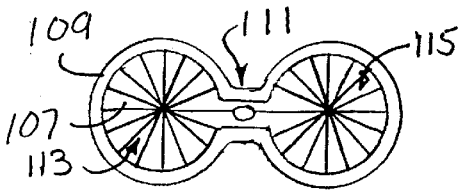

Fig. 32
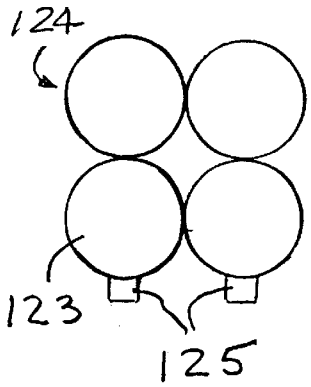
Fig. 33
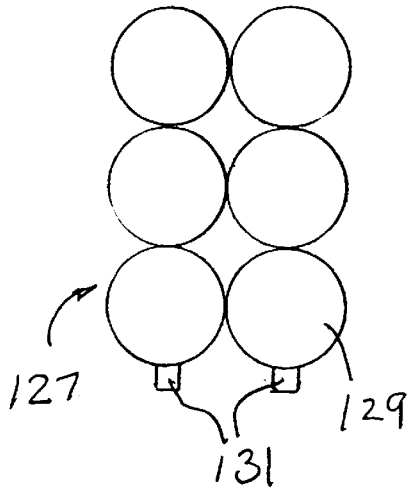
Fig. 34
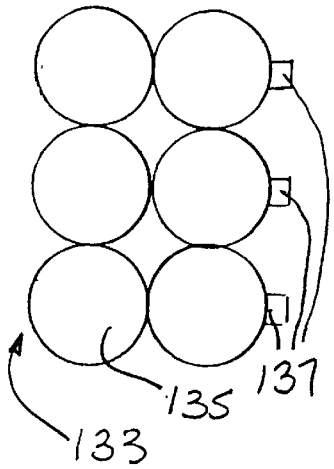
Fig. 35
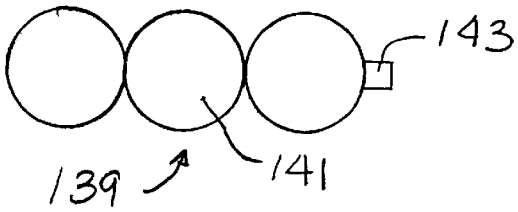
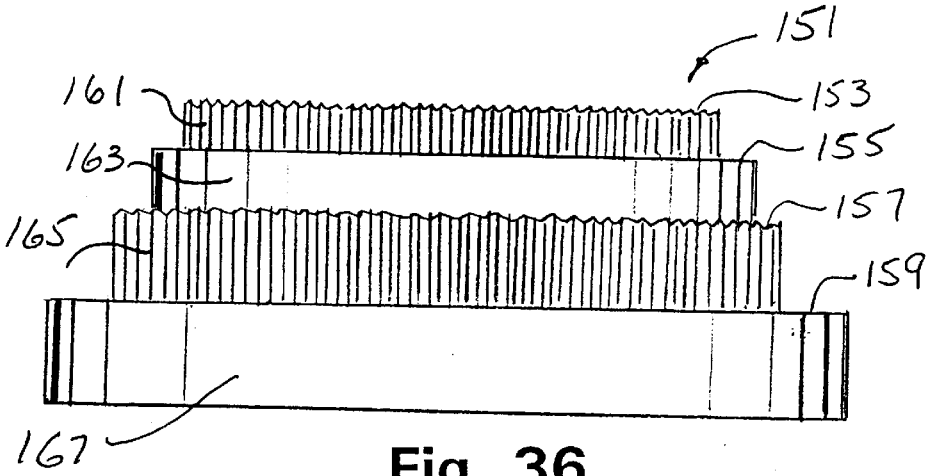
Fig. 36

DECORATIVE JEWELRY ARTICLE

This is a continuation of co-pending U.S. Ser. No. 09/224,936 filed on Dec. 31, 1998, now abandoned.

BACKGROUND OF THE INVENTION

1. Field of the Invention

This invention relates to articles of jewelry, and in particular to a monolithic or modular simulated gem and gem setting arrangement.

2. Brief Description of the Prior Art

Unitary jewelry articles and/or modular links for forming jewelry bracelets, necklaces, pendants, and rings are well known. The so-called tennis bracelet, for example, is a bracelet having a series of connected modular units, each unit comprising an actual diamond or other gem and a setting therefor.

Reference is made to the following U.S. Pat. Nos.:

| U.S. Pat. No. | Inventor(s) |
|---|---|
| Des. 110,568 | L. Garfinkel |
| 1,189,497 | A. Schwartzinan |
| 1,589,423 | H. Payton |
| 1,344,365 | H. Wachenheliner |
| 2,538,090 | H. Ferragamo |
| 4,781,038 | Branca et al. |
| Des. 146,779 | N. Slater |
| Des. 117,577 | J. Sand |
| Des. 257,017 | J. Barr |
| Des. 156,650 | W. W. Pearce et al. |
| 4,763,489 | L. Strong |
| Des. 48,950 | C. Rosenberger |
| 1,410,366 | E. H. Buchman |
| Des. 131,847 | W. W. Hobe |
| 1,153,362 | J. C. Wacha |
| Des. 42,643 | H. H. Meyers |
| Des. 176,664 | Adolph Katz |
| Des. 143,588 | O. Green |
| Des. 265,639 | Josef J. Barr |
| Des. 84,213 | A. E. R. Speidel |
| Des. 56,605 | H. Grasmuk |
| Des. 151,904 | A. Katz |
| Des. 145,426 | J. Braunstein |
| Des. 144,901 | J. Braunstein |
| Des. 160,241 | P. Bardach |

Reference is also made to prior U.S. patent applications of the inventor of the present invention as follows: U.S. patent application Ser. No. 07/572,678, filed Aug. 23, 1990 for "BRACELET DESIGN", now abandoned, which is a continuation application of Design Application Ser. No. 397,094 filed Aug. 22, 1989 entitled "BRACELET OR THE LIKE", now U.S. Pat. No. D314,929.

Non-patent references of interest may include:

1. "Charms" catalog, Page 136, Item #136-20, by Americas GOLD, 650 South Hill St., Los Angeles, Calif. 90014
2. "Liberty Collections" catalog, Pages 4 and 21, by Liberty I. Exchange, 333 Washington St. #203-1, Boston, Mass. 02108;
3. "Diamond Flower" jewelry by S&R Designs, Inc., Marlton, N.J.;
4. Items #P10529, #84619, #84622, National Jeweler, May 16, 1997;
5. Janet Alix necklace, Jewelers' Circular Keystone, May, 1997;
6. Catalog Item #4D, Skalet Gold, 3600 N. Talman Ave., Chicago, Ill. 60618
7. Caroline Ballou Collection, June Las Vegas Show, K25–K27, and Barnett Robinson, Inc. June Las Vegas Show, Galleria #10;

8. Item N362, P.Q.C. Jewelry, National Jeweler, Jun. 1, 1998, Page 142;
9. "Love Tears" collection, by Studs, Inc., 42 W. 48 St., New York, N.Y. 10036;
10. Slide pendant, by Superior Diamond Cutters Inc., 589 Fifth Ave., New York, N.Y. 10017;
11. Uni-Creation, Inc., Emby International, Inc. collection, 589 Fifth Avenue, New York, N.Y. 10017;
12. A Promotional Supplement To JCK, May 1997, Pages 178, 179;
13. Item SS424, Corona Jewellery Company, 16 Ripley Ave., Toronto, Ontario, M6S 3N9, Canada;
14. "Bezel-set jewelry, California Gold Center, 606 S. Hill St., Los Angeles, Calif. 90014;
15. "Partners" fashion jewelry, Cache fashion watches, Mervyn's California catalog flyer, 1998, Page 11;
16. California Precision Products Co. Catalog "Laser Spot-Welding Systems", One Industrial Court, Riverside, R.I. 02915;
17. Maty, Collection Automne—Hiver 97–98, Valeur 30F, No. 76.

The jewelry articles shown and described in the prior art noted above take on various aesthetically pleasing forms for displaying gems, real or simulated, in a variety of visual and structural configurations.

Channel settings and bezel settings that use real gems increase the price of a jewelry item dramatically.

In all such articles of the prior art in which a gem or simulated gem is mounted in a gem setting, the gem or simulated gem is positioned above the setting. In assembling the gem and gem setting combination, typically a series of upwardly directed prongs project from the setting, also referred to as a "base", and the gemstone, or simulated gemstone, is placed within the setting from above, after which the series of prongs are bent downwardly to embrace the gem or simulated gem. While this configuration displays the gem in the foreground relative to the setting, there are many disadvantages to such construction.

In particular, with the prongs of the setting exposed, it is relatively easy to snag clothing or inflict minor injuries to the skin of a person by an inadvertent scraping action. Moreover, the prongs of the setting base are unsightly, detracting from the aesthetic qualities of the article of jewelry.

If one were to conceive of the idea of avoiding the unsightliness of extending mounting prongs, the idea would be quickly rejected, due to the fact that if a precious stone, for example a diamond or ruby, or the like, is mounted below the upper surface of the setting base, the pointed bottom of the stone would penetrate the skin of the user even more so than is commonly done even with stones mounted from the top of a setting base or bezel. The pointed bottom of a precious stone is, by design, formed with specific depth and angles to capture as much light as possible for reflection through the stone, thereby enhancing the brilliance and spectacle of the gem.

Yet another disadvantage of the use of prior art unitary modules for connection in series to form a tennis bracelet, for example, is that such bracelet construction is rather labor intensive, each modular unit having to be connected to an adjacent unit, and for a bracelet with, typically thirty or more, individual modules, the cost of the bracelet to the ultimate consumer may be inflated beyond expectation of the purchaser who values the article of jewelry on the basis of its precious stone content. Typical prong, channel, and bezel settings not only use expensive gems that sometimes get damaged during the setting procedure, but these types of settings themselves are costly. The purchaser would be greatly benefitted by a less costly manufacturing process, since, for the same purchase price, the purchaser would receive more or larger stones, or stones of a greater quality. There is therefore a need in the art for reducing the manufacturing costs of multi-modular jewelry items.

SUMMARY OF THE INVENTION

The present invention satisfies the needs and desires of the purchasing public while simultaneously solving the aforementioned problems associated with jewelry items in which the gem is mounted above the setting.

In accordance with one aspect of the invention, there is provided a decorative jewelry article comprising a hollow base member, a decorative insert, and a fastener arrangement. The hollow base member has a top, a bottom, an interior, and an opening in the top. The decorative insert is sized in relation to the interior of the base member so as to be placed within the hollow base member and viewed through the top opening. The fastener arrangement fixes the decorative insert within the hollow base member below the base member top.

Employing the principles and concepts of the present invention, it will be appreciated that, since the decorative insert or simulated decorative insert is positioned within a base member below the top and above the bottom of the base member, snagging of clothing, and penetration of the user's skin is avoided. Unlike real gems, the simulated gem of the present invention does not extend below the bottom of the base member in which it is contained.

In another aspect of the invention, there is provided a plurality of such hollow base members, or modular links, for example a pair of such base members may be linked together in the manufacturing process so that the number of individual modular units to be assembled to form a tennis bracelet, for example, is halved.

The present invention also provides for a number of selectable structural configurations and mounting processes, depending on need, desired security for a mounted gem or simulated gem, and aesthetic considerations.

BRIEF DESCRIPTION OF THE DRAWING

These and other aspects of the invention will be better understood, and additional features of the invention will be described hereinafter having reference to the accompanying drawings in which:

FIG. 5 is a perspective view of a jewelry article arrangement comprising a hollow base member and a decorative insert, made in accordance with the present invention;

FIG. 6 is a perspective view of a single unitary jewelry article mounted in a ring setting;

FIG. 7 is a perspective view of an alternative design for the base member from that shown in FIG. 5;

FIG. 8 is a perspective view of an integral base and decorative element comprising a decorative jewelry article according to the present invention;

FIG. 9 is a plan view of the jewelry article shown in FIG. 5;

FIG. 10 is a right side view of the jewelry article shown in FIG. 9;

FIG. 11 is a bottom plan view of the jewelry article shown in FIG. 9;

FIG. 12 is a cross sectional view of the jewelry article shown in FIG. 5, the figure showing both the base member and decorative insert in cross section;

FIG. 13 is a cross sectional view of a base member and decorative insert in a completely assembled condition;

FIG. 14 is a cross sectional view of an alternate fastener arrangement for retaining the insert within the hollow base member;

FIG. 24 shows a cross sectional view of a unitary, integral, simulated gem and setting, and also shows a technique for depositing a coating on the decorative pattern below the top surface;

FIG. 25 is a magnified view of the portion of FIG. 24 marked with the circle 25;

FIG. 26 shows yet a further configuration of a segment of a tennis bracelet employing the dual-segment base member/decorative insert technology in accordance with the present invention;

FIG. 27 is a top plan view of an alternative configuration for a dual-segment decorative insert, distinguished from that of FIG. 20;

FIG. 28 is a top plan view of a dual-segment jewelry item employing the dual-segment decorative insert shown in FIG. 27.

FIG. 32 is a schematic representation of a four segment decorative jewelry article;

FIG. 33 is a schematic representation of a six segment decorative jewelry article connectable in series longitudinally of the connected articles;

FIG. 34 is a schematic representation of a six segment decorative jewelry article connectable in series laterally of the connected articles;

FIG. 35 is a schematic representation of a three segment decorative jewelry article connectable in series longitudinally of the connected articles; and FIG. 36 is a side elevational view of a variation of the stepped embodiment shown in FIG. 7, the former having additional steps and a variety of surface finishes or textures.

DETAILED DESCRIPTION OF THE PREFERRED EMBODIMENTS

Figure 1:
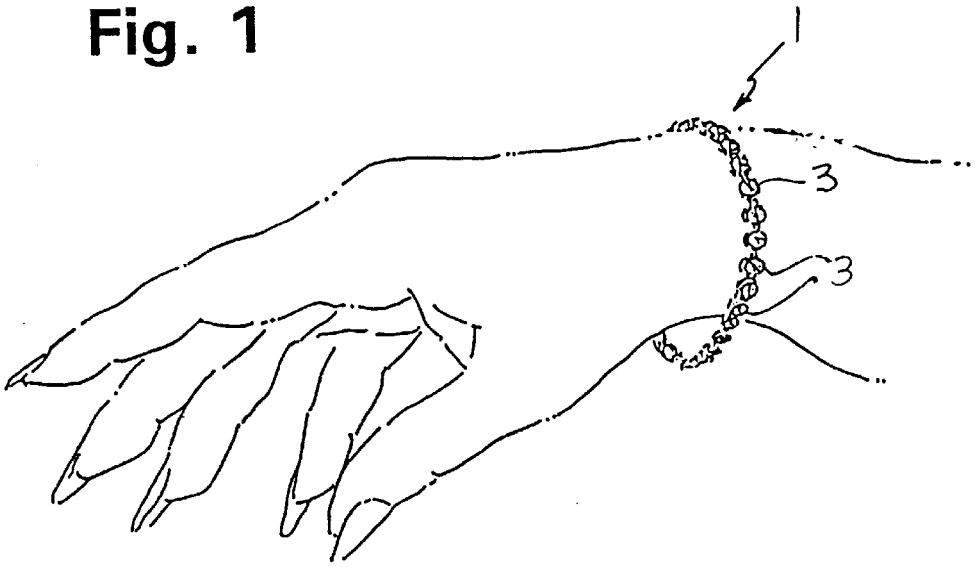
FIG. 1 is a perspective view showing a tennis bracelet employing the concepts of the present invention, as worn on a person's wrist, the bracelet including a series of hingedly interlinked individual modules or links.
Figure 2:
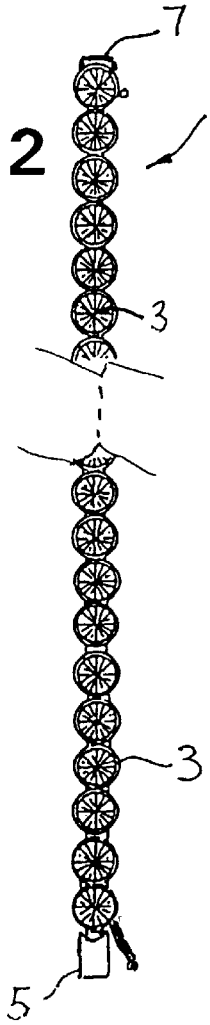
FIG. 2 is a top plan view of the bracelet of FIG. 1, in an unlatched and laid out condition.
Figure 3:
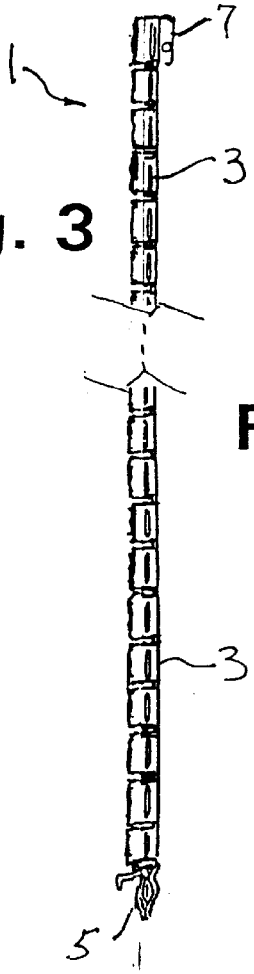
FIG. 3 is a side view of the bracelet of FIG. 2.
Figure 4:
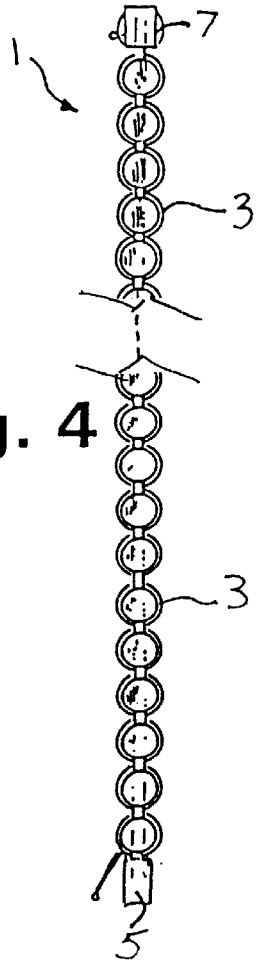
FIG. 4 is a bottom view of the bracelet of FIG. 2.

Those skilled in the art will appreciate that jewelry items may take on a myriad of different shapes and sizes, and certain jewelry designs will be appropriate for any number of different jewelry items, such as bracelets, necklaces, rings, broaches, pendants, studs, and the like. Accordingly, it will be understood that, although the present invention will be described in terms of primarily a jewelry article having a cylindrical shape in horizontal cross section or a generally figure-8 geometrical configuration, the concepts of the invention are equally applicable to other geometric designs and shapes, for example articles having a heart-shape, a triangular shape, a square or rectangular shape, an oval shape, or a multi-sided polygon shape, a pear shape, a marquise shape, or an elliptical shape, to name a few.

It will also be understood that the present invention is not particularly involved with the specific type of connecting means or latch means for a multi-modular bracelet. For those functions, a person of ordinary skill in the art will be presumed to follow traditional structures and processes. Thus, the application of the present invention to the jewelry industry is not limited to bracelets, rings, or other jewelry items shown and described herein. It will also be understood that the concepts of the present invention may be implemented in a piece of Jewelry independent of whether or not the jewelry article is comprised of a singular integral material or of a multi-part construction such as a base support member with a decorative insert confined therein.

In a tennis bracelet 1, such as that shown in FIGS. 1–4, each module 3 of the tennis bracelet is made with a number of hingedly interlinked individual unitary modules 3 linked with like modules to form the bracelet. An appropriate latch means 5, 7 connected to opposite ends of the bracelet 1, may be of ordinary design and function, such as a conventional tongue and groove fastener.

A first embodiment of the invention is shown in FIGS. 5, 6, and 9–13. In this embodiment, each jewelry article or item, hereinafter also referred to as a module or modular link 3 is provided with a base support member 13 embracing within its interior a decorative insert 17 which is preferable plate-shaped. Base support member 13 has a top portion shown in FIGS. 5, 6, and 9–13 as being planar. The top surface 15 has an opening 16 through which may be viewed the decorative insert 17 which lies below the top surface 15 (in all embodiments of the invention).

The lower portion of the base member 13 may be provided with optional cut-outs or "windows" 19 to reduce weight, and, in a bracelet application, base member 13 has a linking means 11 with a bendable end portion 12 for connection to a like jewelry module 3.

The module 3 of FIG. 6 does not possess a linking means, as it will be mounted on the base of, or be an integral part of, a ring, earring, charm, pendant, broach, cufflink, or the like.

In the FIG. 5 embodiment, it will be observed that the base member 13 is of a hollow cylindrical configuration having a continuous sidewall and planar top 15, except for the cut-outs, or "windows" 19.

FIG. 7 differs from FIG. 5, in that the upper peripheral edge of the base member 13A has a stepped configuration defined by a vertical wall portion 16 and a horizontal step portion 23, the horizontal step portion 23 having an irregular exposed surface. Although the horizontal step portion 23 may take on a variety of visual characteristics, the preferred embodiment of FIG. 7 shows the horizontal step portion 23 as a series of generally V-shaped or sawtooth serrations or indentations as viewed in side elevation.

It will also be observed by reference to FIG. 7 that the top surface 15A of module 3A is conical. It is contemplated that, if decided, the conical surface 15A may be convex or concave at the discretion of the jewelry designer. However, even in a concave configuration, the lowest part of the top surface 15A will always be above the uppermost surface of the decorative insert 17 in order to be consistent with one of the major features of the present invention.

The embodiment of FIG. 8 differs from that of FIGS. 5 and 7, in that it is manufactured in monolithic, or integral fashion, i.e. the module 3B of FIG. 8 comprises a base member 13B and integral decorative element 17B. For example, the module 3B may be cast in solid gold with the surface of the decorative portion 17B highly polished for simulating a gem or other type of attractive insert, when in fact the decorative portion 17B is not a separate physical element. Due to the lack of any need for a fastener arrangement in module 3B, the windows 19B may be made quite large (significantly larger than that schematically shown in FIG. 8) relative to the size of the base member 13B to present a rather delicate appearing bracelet link.

FIGS. 9–11 show a top, side, and bottom view of the module 3 of FIG. 5. With particular reference to FIG. 11, and the cross sectional views of FIGS. 12 and 13, the interior of the hollow base member 13 is thickened at its upper portion defining an integral interior annular band 27, best seen in FIG. 12. Projecting downwardly from annular band 27 at a selected number of positions distributed angularly thereon are a number of projecting tabs or prongs 29. In FIG. 11, four such tabs or prongs 29 are shown. However, any number of tabs may be provided, as desired.

These tabs or prongs 29 are formed during manufacture as a number of downwardly projecting elements as best seen in FIG. 12. After a plate-like decorative insert 17 is inserted from the bottom of the hollow base member 13 past the tips of the projecting tabs or prongs 29, the projecting tabs or prongs 29 are bent upwardly (FIG. 13) against the rear surface 25 of the decorative insert 17 to retain the insert 17 in place within the hollow base member 13.

In the preferred embodiments of the invention, the decorative inserts, such as insert 17, are plate-like elements having been scored radially from the center to present numerous facets 39, or are formed with a pattern of v-shaped grooves radiating from the center of the plates. Variations of such patterning will be seen in the dual-segmented decorative inserts 63 and 107 of FIGS. 20 and 27, respectively.

To insure stability and facilitate the mounting of decorative insert 17 within hollow base member 13, the circular band 27 in the upper portion of base member 13 leads to an integral inwardly directed annular rim 41 surrounding the top opening 16. Annular rim 41 is shown in FIG. 12 to be inwardly directed from the top of the annular band 27, and thus defines a horizontally oriented annular surface 33 facing downwardly.

In this connection, the upper peripheral edge 33 of decorative insert 17 is designed to have predetermined, reasonably precise, outer peripheral dimensions, in the circular embodiment shown in the drawing, for example, a specific outer diameter. Peripheral edge 35 fits precisely with the inwardly facing annular surface 34 and smoothly against the downwardly facing annular surface 33. This insures proper positioning and a proper centering of insert 17, and prevents insert 17 from moving laterally within base member 13.

In a variation of this embodiment of the invention, the outer peripheral surface of insert 17 and the inwardly facing inner surface 34 of the base member 13 may define complementary sloping walls(if circular-conical walls) to further ensure a solid mounting and centering of insert 17 within base member 13.

In FIGS. 12 and 13, it is illustrated that the insert 17 is moved into contact with downwardly facing annular surface 33, and then the fastener arrangement, i.e. projecting tabs or prongs 29 are bent against rear surface 25 to capture the insert 17 between the annular rim 41 and the bent tabs or prongs 29. In FIG. 14, a more simplified assembly of the insert 17 into a hollow base member 13C is suggested, whereby the base member 13C is manufactured with one or more inwardly directed short ledges 43. To assemble the module 3C, one end of insert 17 is placed on the ledge or ledges 43 and swung up past one or more projecting tabs or prongs 29, after which the one or more tabs or prongs 29 will be bent against the rear surface 25 of insert 17 in a manner similar to that shown in FIG. 13.

Figure 15:
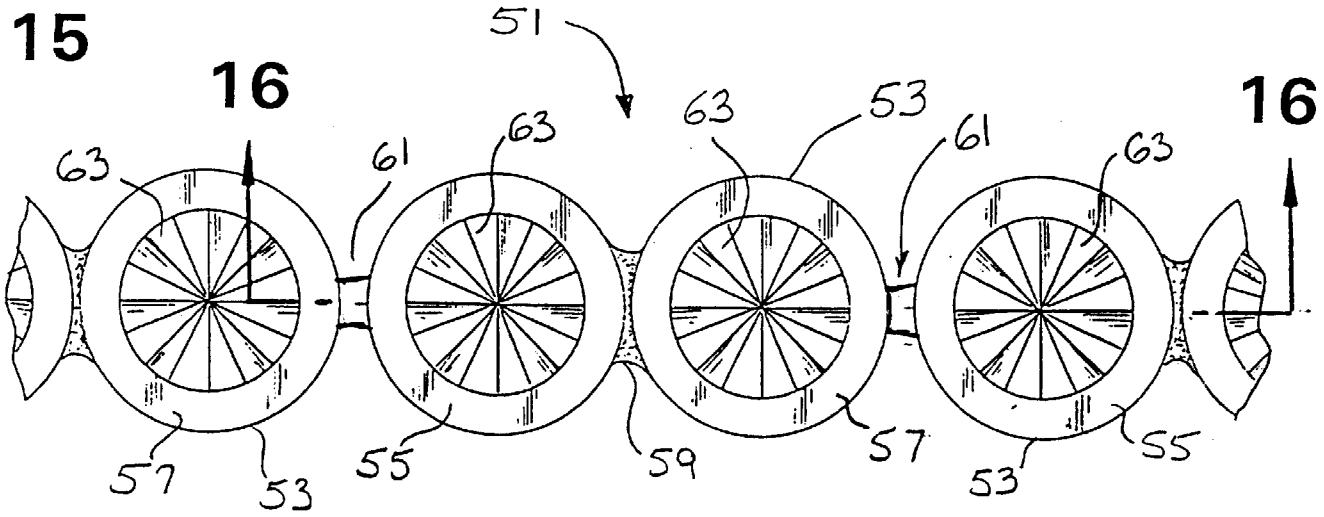
FIG. 15 is a top plan view of a segment an alternate design for a tennis bracelet in which pairs of decorative jewelry articles are manufactured as unitary dual-segment jewel items hingedly interlinked to form a tennis bracelet.
Figure 16:
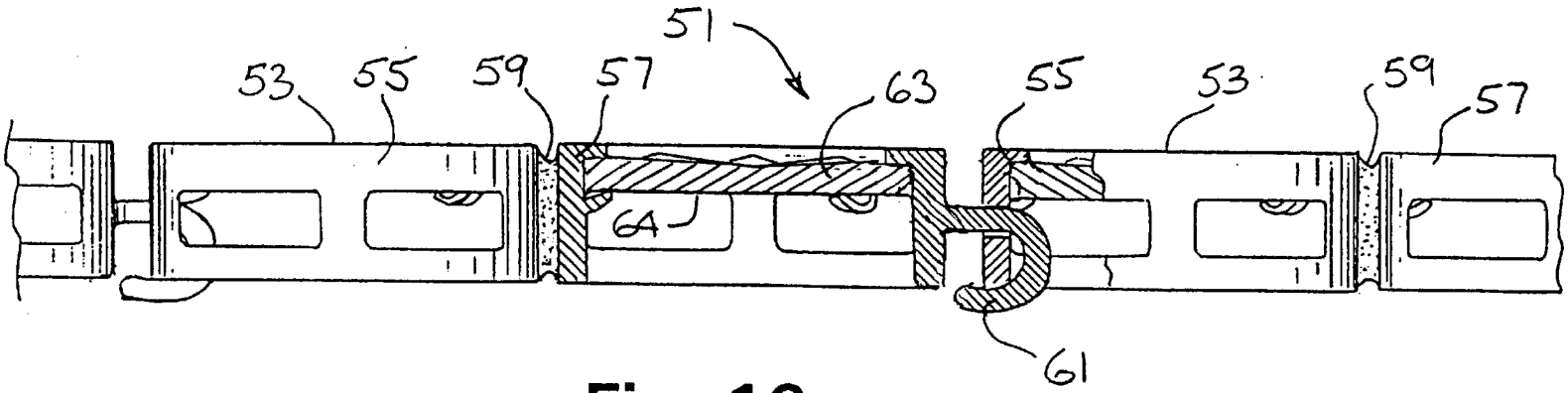
FIG. 16 is a partial cross sectional view of the tennis bracelet segment shown in FIG. 15.
Figure 17:
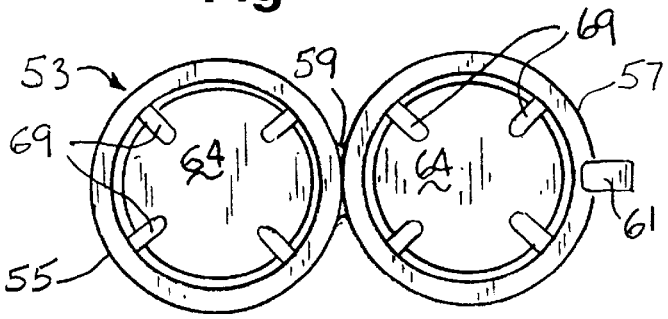
FIG. 17 is a bottom plan view of one of the dual-segment jewelry items shown in FIG. 15, each segment displaying a separate individual decorative insert.

FIGS. 15–17 depict an embodiment of the invention in which the decorative jewelry article is formed of an assembled series of modules; however, in this embodiment of the invention, the individual modules are dual-segmented. That is, they are comprised of a pair of base members 55, 57 and a corresponding pair of decorative inserts 63. The module 53 of FIG. 17, for example, has the appearance of a pair of modules 3 permanently attached at 59. The dual-segmented configuration results in an equally attractive jewelry article, but has advantages in lowering labor costs in the manufacturing process.

It should be noted that, in manufacturing the module 53, the two separate base portions 55, 57 may be connected by means of welding, or the double base portion configuration shown in FIG. 17 may be cast as a single dual-base piece. In either case, the assembly of a bracelet 51 is made simpler by the fact that half as many modules 53 need connecting together to form a tennis bracelet than if the module 53 was divided into separate individual modules such as that shown in FIG. 5.

It will be understood that more than two segments 3, 3A, 3B, 3C, for example, may be fixedly attached to form a multi-segment jewelry module. Only single-segment and dual-segment modules are described herein in detail for ease of presentation. Also, multiple-segment modules may be designed with all segments in a planar alignment, or with the segments connected so as to form a slightly arcuate module for more closely conforming to the curvature of a persons wrist.

As with the FIG. 11 embodiment, each base portion, i.e. a first base portion 55 and a second base portion 57, is provided with originally downwardly directed tabs or prongs 69, and after a pair of decorative inserts 63 are installed, the tabs or prongs 69 are bent to apply pressure against the rear surfaces 64 of inserts 63.

FIG. 15 shows a segment of a completed tennis bracelet 51 having the first and second base portion 55, 57, respectively, welded as shown at 59, and each base portion 55, 57 securely houses a separate decorative insert 63 employing the function and procedure described in connection with FIGS. 12 and 13. Connecting the dual-segment base module 53 with the linking means 61 is evident by reference FIG. 16.

FIGS. 18–23 illustrate a dual-segment module 73 differing in construction from that of FIGS. 15–17. In FIGS. 18–23, the hollow base member 74 has a figure-8 shape with a first base portion 76 and a second base portion 78. About the inner periphery of each base portion 76, 78, there is provided an annular rim 75, 77, respectively. Annular rims 75, 77 serve the same purpose as the annular rim 41 described in connection with FIG. 12. That is, annular rims 75, 77 provide a stop for an insert 63 (FIG. 20) moving in the bottom-to-top direction.

Figure 20:
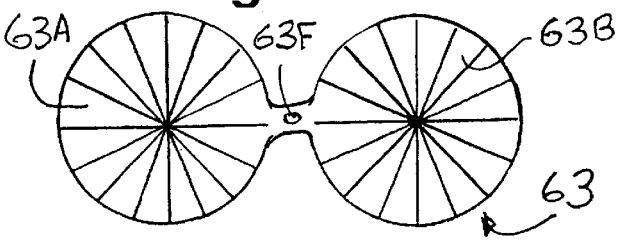
FIG. 20 is a top plan view of a dual-segment decorative insert of the type to be inserted in the dual-segment hollow base member shown in FIG. 18.
Figure 21:
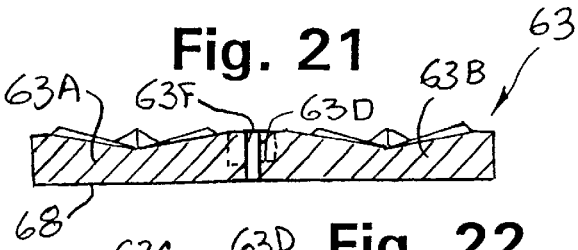
FIG. 21 is a side cross sectional view of the dual-segment insert shown in FIG. 20.

As observed in FIGS. 20 and 21, the dual-segment insert 63 is likewise figure-8 shaped, with a pair of nearly circular faceted decorative surfaces 63A and 63B.

Figure 18:
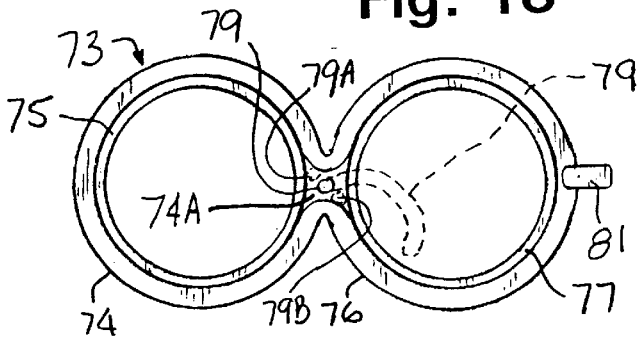
FIG. 18 is a bottom plan view of an alternative form of a dual-segment hollow base member in which may be inserted the decorative insert of FIG. 20.
Figure 23:
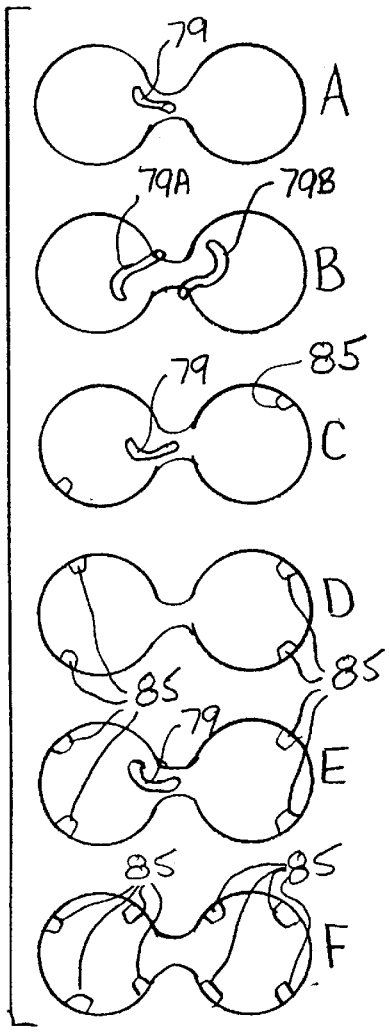
FIGS. 23A–F show, schematically, six different preferred prong configurations for fixing a dual-segment decorative insert into a dual-segment hollow base member.
Figure 19:
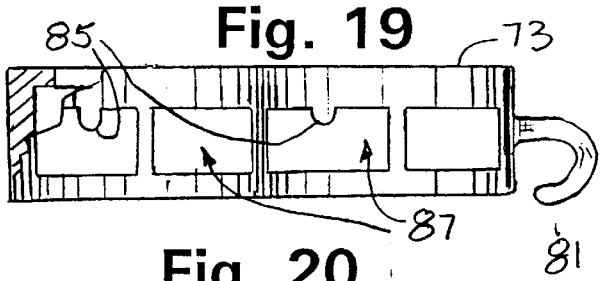
FIG. 19 is a side elevation view of the dual-segment jewelry item shown in FIG. 23 with additional, optional, mounting prongs for retaining the decorative insert in place.

FIG. 19 is a side view of the two-portion module 73 showing the position of the linking means 81 and a number of open windows 87. It will be recalled that, in the single and double base configurations of FIGS. 12 and 17, a thickened upper portion, denoted as annular band 27 is formed with the downwardly depending projecting tabs or prongs 29, 69. In the embodiment of FIGS. 18–23, there is no need for an annular band, since the downwardly projecting tabs or prongs 85 are formed depending from the upper frame of one or more of the windows 87. When the prongs 85 are bent inwardly against the rear surface 68 (see FIG. 21) of the decorative insert 63, the tabs or prongs 85 are virtually not visible and thus do not detract from the beauty of the jewelry article.

In addition to a number of tabs or prongs 85 around the periphery of each base portion 76, 78, the module 73 may be cast with a projecting central prong 79 which may extend downwardly from the center of the module 73, and/or one or two prongs may be formed at one or two locations 79A and 79B, depending on the number of prongs required, necessary, or desired for retaining the insert 63 in position.

In this respect, FIGS. 23A–23F show the tab or prong positions for a number of possible configurations for the tabs or prongs employed to retain the insert 63 in place. That is, FIGS. 23A–23F show, in order, the configuration for retaining insert 63 by means of a single prong, two prongs, three prongs, four prongs, five prongs, and eight prongs. These configurations, and others which are possible with the construction and description of the embodiment of FIGS. 18–23, are possible and at the discretion of the jewelry article designer.

FIG. 21 is a cross sectional view of the insert 63 shown in FIG. 20, FIG. 21 showing the two faceted regions 63A and 63B which are viewable through openings 80 and 82 in the first and second base portions 76, 78, respectively. Central hole 63F is positioned and sized to receive prong 79 of the dual-segment base member 74 (FIG. 18).

The dashed lines in FIG. 21 show an offset in insert 63, defining a depression 63D for bridging across connection 74A (FIG. 18) when such connection 74A is at a position in base member 74 lower than the annular rims 75, 77.

Figure 22:
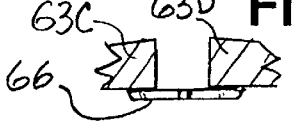
FIG. 22 shows an alternate construction for joining the two halves of a dual-segment decorative insert, distinguished from that shown in FIG. 21.

FIG. 22 illustrates the possibility of connecting individual circular inserts 63C and 63D by a bridge strap 66, a plan view of such configuration being substantially the same as that shown in FIG. 20. The advantage of the FIG. 22 arrangement is that the same inserts can be used in the dual-segment base configuration as used in the single-segment base configuration.

Not shown in the drawings is another possible embodiment for the dual-segment, figure-8, base configuration. Such an alternative configuration would have both base portions 76 and 78 constructed similar to the single base portion embodiment of FIG. 8. That is, the entire module 73 may be formed by an integral, monolithic, casting, in which case there would be no need for any tabs or prongs 79, 79A, 79B, or 85.

FIG. 24 is relevant in this respect, as it shows, in cross section, the integral, monolithic, module 3B in which the faceted design 95, formed by the casting process, is enhanced in reflectivity and luster by coating the surface 95 with rhodium or other material 93 from a nozzle 91. The process forms a layer 97 which additionally protects the decorative portion against corrosion.

FIG. 26 illustrates an alternative shape for the individual base portions of a bracelet segment 99. Here, the dual-segment modules 105 are comprised of a pair of heart-shaped base members 101, 103. FIG. 26 is thus suggestive that the choice for a geometrical configuration of the base portion, or base portions, is virtually unlimited. For example, it is within the scope of the present invention to construct a decorative jewelry article having a round or square base with a heart-shaped cutout in the upper surface thereof, and with a round or square decorative insert mounted underneath, and exposed through, the heart-shaped cutout.

FIGS. 27 and 28 show the construction of another variation of the dual-segmented decorative insert similar to that of FIG. 18, except that the front of the dual-segmented base 109 has an open and continuous channel 111 leading to both end openings 113 and 115, while the view from above for the configuration of FIGS. 18–23 which reveal two separate, and isolated, faceted surfaces 63A and 63B. In FIG. 28, a connecting part of the faceted insert 107 is visible in the open channel 111 creating an unusual visual effect for the module.

Figure 29:
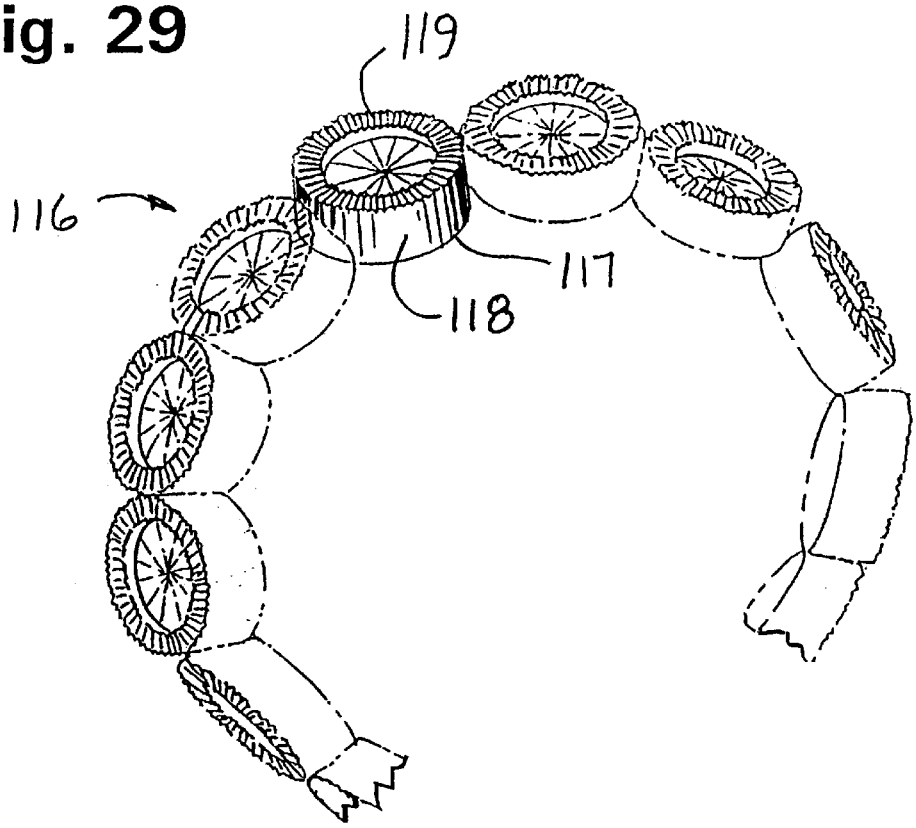
FIG. 29 is a partial perspective drawing showing connected ones of the decorative jewelry article in a bracelet form.

FIG. 29 is a partial perspective drawing showing connected ones of the decorative jewelry article 117 forming a bracelet 116. The individual articles 117 may be welded or soldered together in any desired pattern, FIG. 29 being an example only. In FIG. 29, each connected module has a knurled annular top surface and a smooth cylindrical side surface.

Figure 30:
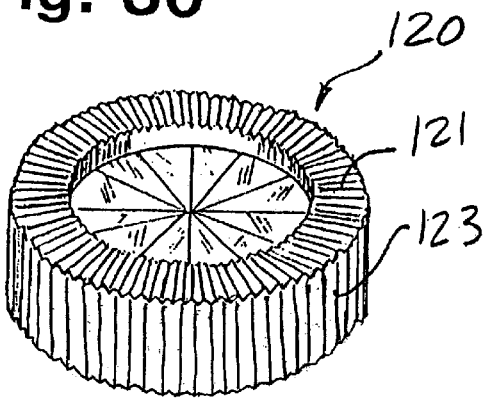
FIG. 30 shows an alternate surface texture treatment of the base member from that shown in FIGS. 5–10.

FIG. 30 shows a decorative jewelry article 120 having alternate surface texture treatments of the base member exposed surfaces 121, 123 from that shown in FIGS. 5–10.

Figure 31:
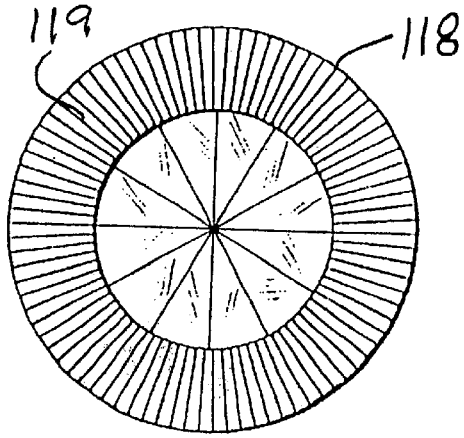
FIG. 31 is a top plan view of a decorative jewelry article having a base similar to that of FIG. 30, but with a smooth outer side surface and a wider annular top surface.

FIG. 31 is a top plan view of a decorative jewelry article having a base member similar to that of FIG. 30, but with a smooth outer side surface 118 and a wider knurled annular top surface 119.

FIG. 32 is a schematic representation of a four segment decorative jewelry article 124 having modules 123 of any style hereinbefore described, and with linking means 125 extending from two parallel modules along one side of the article 124.

FIG. 33 is a schematic representation of a six segment decorative jewelry article 127, having modules 129 and linking means 131, a number of such articles 127 being connectable in series longitudinally of the connected articles.

FIG. 34 is a schematic representation also of a six segment decorative jewelry article 133, but with three linking means 137 extending from three aligned modules 135, a number of such articles 133 being connectable in series laterally of the connected articles.

FIG. 35 is a schematic representation of a decorative jewelry article 139 having three segments 141 and a single linking means 143, a number of such articles 139 being connectable in series longitudinally of the connected articles.

It is to be understood that the number of connected modules to form a multiple-segment decorative jewelry article, and the geometrical arrangement of such connected modules, is virtually limitless. The specific arrangements shown and described herein are exemplary only.

FIG. 36 is a side elevational view of a module 151 which is a variation of the stepped embodiment of the module shown in FIG. 7, the former shown to have additional horizontal annular surfaces (steps) 153, 155, 157, 159 and to have vertical cylindrical surfaces 161, 163, 165, 167 of different surface finishes or textures.

While only certain embodiments of the invention have been set forth above, alternative embodiments and various modifications will be apparent from the above description and the accompanying drawing to those skilled in the art. For example, in the preferred embodiment of a circular base member 13, the faceted insert 17 and the inner annular surfaces 33, 34 may be square shaped, diamond shaped, heart shaped, and the like, while the outer appearance of the base member 13 may remain circular. Similarly, base member 13 may be square shaped, diamond shaped, heart shaped, and the like, while the faceted insert 17 may be circular. Any combination of these and other geometric shapes are intended to be within the scope of the invention.

Likewise, it is contemplated that features such as serrated surfaces, smooth surfaces, faceted surfaces, planar surfaces, conical surfaces, straight peripheral sides, stepped peripheral sides, as well as shapes of base members and inserts as described herein, may be combined in a virtually limitless number of arrangements and presentations.

Additionally, although single and dual-segmented decorative jewelry articles are shown and described in detail herein, any desired number of segments may be selected, the construction of which would be well within the skill of a person working in the jewelry art following the teaching in this description.

As described, the decorative insert(s) and exposed surfaces of the stepped portion of the base units have preferred surface textures as shown and described. However, at the discretion of the designer, any or selected ones of such surfaces may be faceted, knurled, smooth, shiny, colored, frosted, or formed with diffraction gratings or filigree patterns, or may have thereon random markings, organized markings, and/or may be textured to simulate real gems.

If desired, rather than manufacturing the decorative jewelry article as a modular multi-piece decorative article, the invention may be implemented as a unitary arrangement of component parts with an internal simulated decorative insert.

In the preferred embodiments shown and described herein, the fastening means for fixing the decorative insert in the base unit uses bendable fingers pressing against the back side of the insert after it is in place within the interior of the base member. Alternatively, the insert(s) may be fixed in place by other methods, such as soldering, swaging, scoring, and welding including laser welding. Swaging, scoring, and laser welding are techniques that work well with the decorative insert arrangement of the present invention, but are not suitable for fixing real gems in place due in large part to the configuration, shape, and weight of real gems. As to laser welding, reference is made to the apparatus and methods of laser welding techniques disclosed in California Precision Products Co. Catalog "Laser Spot-Welding Systems", One Industrial Court, Riverside, R.I. 02915, such document incorporated herein by reference.

These and other alternatives and variations are considered equivalents and within the spirit and scope of the present invention.

What is claimed is:

1. A decorative jewelry article, comprising:

a base member having an encompassing sidewall defining a hollow base member interior, a top with an opening therein leading to said hollow base member interior, a bottom, and a fastener arrangement integrally formed on said base member interior; and a separate decorative insert, having a multi-faceted top surface, held in place within said hollow interior by said fastener arrangement, below said base member top and above said base member bottom, said multi-faceted top surface being viewable through said top opening, wherein said fastener arrangement comprises at least one tab integrally formed on said sidewall within said hollow base member interior.

2. The decorative jewelry article as claimed in claim 1, wherein:

said base member has an integral interior rim surrounding said top opening, said rim having a bottom surface defining a stop against which said decorative insert abuts.

3. The decorative jewelry article as claimed in claim 2, wherein:

said decorative insert is captured between said interior rim and said fastener arrangement.

4. The decorative jewelry article as claimed in claim 3, wherein:

said interior rim comprises an integral interior annular band disposed on the interior of said base member, said band having a bottom spaced from said base member bottom;

said decorative insert is generally plate-shaped and has a bottom surface; and said at least one tab projects downwardly and is bendable inwardly of said base member interior, against the bottom surface of said decorative insert, whereby said decorative insert is captured between said interior rim and said at least one tab.

5. The decorative jewelry article as claimed in claim 2, wherein:

said decorative insert is generally plate-shaped and has a bottom surface;

said fastener arrangement comprises at least one bendable tab integrally formed on said base member and projecting downwardly; and said at least one tab projects downwardly and is bendable inwardly of said base member interior, against the bottom surface of said decorative insert, whereby said decorative insert is captured between said interior rim and said at least one tab.

6. The decorative jewelry article as claimed in claim 5, wherein:

said base member has at least one side opening, said at least one side opening extending from an exterior base member surface to an interior base member surface: and said at least one tab is formed as a projection from a peripheral edge of said at least one side opening.

7. The decorative jewelry article as claimed in claim 5, wherein:

said at least one bendable tab projects downwardly from said integral interior rim.

8. The decorative jewelry article as claimed in claim 5, wherein:

said fastener arrangement comprises at least one inwardly directed short ledge projecting inwardly from said base member interior and spaced from said integral interior rim, an edge of said decorative insert being supported by said at least one ledge, and said at least one tab being bent against said bottom surface of said decorative insert thereby capturing said decorative insert below said integral interior rim and above said at least one short ledge and said at least one tab.

9. The decorative jewelry article as claimed in claim 2, wherein:

said decorative insert is plate-shaped and has a bottom surface;

said base member hollow interior has an interior peripheral wall surface;

said fastener arrangement comprises at least one bendable tab integrally formed on the interior of said base member and projecting downwardly from said interior peripheral wall surface; and said at least one tab is bendable inwardly of said base member interior, against said decorative insert bottom surface, whereby said decorative insert is captured between said interior rim and said at least one tab.

10. The decorative jewelry article as claimed in claim 2, wherein:

said base member is segmented, defining a plurality of base member segments fixedly connected together side-by-side;

said decorative jewelry article comprises a plurality of said inserts; and each said base member segment embraces one of said plurality of decorative inserts below said base member top, each said decorative insert being fixed within its respective base member segment.

11. The decorative jewelry article as claimed in claim 10, wherein:

said base member comprises a linking arrangement for linking said decorative jewelry article base member to a like decorative jewelry article base member.

12. The decorative jewelry article as claimed in claim 10, wherein:

each said base member segment has an integral interior rim surrounding said top opening, each said rim having a bottom surface defining a stop against which a corresponding decorative insert abuts.

13. The decorative jewelry article as claimed in claim 1, wherein:

said base member is segmented, defining a plurality of substantially identical base member segments fixedly connected together side-by-side;

said decorative insert is segmented, defining a like plurality of substantially identical insert segments fixedly connected together side-by-side, said segmented decorative insert being fixed within said segmented base member below said base member top.

14. The decorative jewelry article as claimed in claim 13, wherein:

said base member has an integral interior rim surrounding said top opening, said rim having a bottom surface defining a stop against which said decorative insert abuts.

15. The decorative jewelry article as claimed in claim 14, wherein:

said decorative insert is captured between said interior rim and the fastener arrangement fixing said decorative insert within said base member below said top.

16. The decorative jewelry article as claimed in claim 14, wherein:

said decorative insert is plate-shaped and has a bottom surface;

said fastener arrangement comprises at least one bendable tab integrally formed on the interior of said member and projecting downwardly; and said at least one tab is bendable inwardly of said base member interior, against the bottom surface of said decorative insert, whereby said decorative insert is captured between said interior rim and said at least one tab.

17. The decorative jewelry article as claimed in claim 16, wherein:

said base member has at least one side opening extending from an exterior base member surface to an interior base member surface; and said at least one tab is formed as a projection from a peripheral edge of said side opening.

18. The decorative jewelry article as claimed in claim 1, in combination with additional ones of said decorative jewelry article as claimed in claim 1, to define a plurality of decorative jewelry articles all fixedly connected together side-by-side, said plurality of fixedly connected decorative jewelry articles being arranged in a generally rectangular configuration having two long sides and two short sides, and further comprising a linking arrangement for interlinking said plurality of fixedly connected decorative jewelry articles to a like plurality of fixedly connected decorative jewelry articles along said short sides.

19. The decorative jewelry article as claimed in claim 1, in combination with additional ones of said decorative jewelry article as claimed in claim 1, to define a plurality of decorative jewelry articles all fixedly connected together side-by-side, said plurality of fixedly connected decorative jewelry articles being arranged in a generally rectangular configuration having two long sides and two short sides, and further comprising a linking arrangement for interlinking said plurality of fixedly connected decorative jewelry articles to a like plurality of fixedly connected decorative jewelry articles along said long sides.

20. The decorative jewelry article as claimed in claim 19, wherein:

each decorative insert of said plurality of fixedly connected decorative jewelry articles is captured between an interior rim and said fastener arrangement in each base member of each of said plurality of fixedly connected decorative jewelry articles, fixing each said decorative insert within each said base member below said top.

21. The decorative jewelry as claimed in claim 20, wherein:

each said decorative insert is plate-shaped and has a bottom surface;

each said fastener arrangement comprises a said at least one tab, each said tab being bendable and projecting downwardly from each said base member; and each said at least one tab is bendable inwardly of each said base member interior, against the bottom surface of a respective decorative insert, whereby each said inserted decorative insert is captured between a respective interior rim and each said at least one tab.

22. The decorative jewelry article as claimed in claim 21, wherein:

each said base member segment has at least one side opening, said at least one side opening extending from an exterior base member surface to an interior base member surface: and said at least one tab is formed as a projection from a peripheral edge of said at least one side opening.

23. A decorative jewelry article, comprising:

a base member having an encompassing sidewall defining a hollow base member interior, a top with an opening therein leading to said hollow base member interior, a bottom, and a fastener arrangement integrally formed on said base member interior; and a separate decorative insert, having a multi-faceted top surface, held in place within said hollow interior by said fastener arrangement, below said base member top and above said base member bottom, said multi-faceted top surface being viewable through said top opening, wherein said decorative insert is fixed within said base member by a process selected from the group consisting of welding including laser welding, soldering, swaging, and scoring.

24. A decorative jewelry article, comprising:

a base member having a hollow interior, a top with an opening therein, leading to said hollow interior, and a bottom;

a decorative insert having top and bottom surfaces placed within said hollow interior;

an integral interior annular rim within said base member segment surrounding said top opening, said annular rim defining a stop against which a corresponding decorative insert abuts upon movement of said corresponding decorative insert within said base member segment in a bottom-to-top direction; and a fastener arrangement, formed on the hollow interior of said base member, for applying pressure against the bottom surface of said decorative insert, thereby capturing said decorative insert between said interior annular rim and said fastener arrangement, wherein:

said decorative insert is plate-shaped;

said fastener arrangement comprises at least one bendable tab integrally formed on the interior of said base member and projecting downwardly; and said at least one tab is bendable inwardly of said base member interior, against the bottom surface of said decorative insert, whereby said inserted decorative insert is captured between said rim and said at least one tab.

* * * * *